US007320148B1

(12) United States Patent
Willette

(10) Patent No.: US 7,320,148 B1
(45) Date of Patent: Jan. 22, 2008

(54) HAIRBRUSH ASSEMBLY

(76) Inventor: Peter A. Willette, 64 Cedar St., Middletown, CT (US) 06457

( * ) Notice: Subject to any disclaimer, the term of this patent is extended or adjusted under 35 U.S.C. 154(b) by 118 days.

(21) Appl. No.: 11/287,439

(22) Filed: Nov. 28, 2005

(51) Int. Cl.
*A46B 7/02* (2006.01)

(52) U.S. Cl. ..... 15/203; 15/169; 15/184; 132/119; 132/120; 132/121; 132/123; 132/151

(58) Field of Classification Search ..... 15/169, 15/184, 185, 201, 203; 132/119–123, 151, 132/289, 290, 313
See application file for complete search history.

(56) References Cited

U.S. PATENT DOCUMENTS

| | | | | |
|---|---|---|---|---|
| 2,244,068 | A * | 6/1941 | Kay | 132/123 |
| 3,108,305 | A | 10/1963 | Peiler | |
| 3,765,047 | A | 10/1973 | Green et al. | |
| 4,023,230 | A | 5/1977 | Friedman et al. | |
| 4,467,821 | A * | 8/1984 | Stewart | 132/123 |
| D280,954 | S | 10/1985 | Rittenhouse | |
| 4,567,905 | A * | 2/1986 | Stewart et al. | 132/212 |
| 4,574,416 | A | 3/1986 | Stewart et al. | |
| 6,070,594 | A * | 6/2000 | Mears | 132/123 |
| 6,408,475 | B1 | 6/2002 | Morrison | |
| 6,681,775 | B2 | 1/2004 | Wang | |

* cited by examiner

*Primary Examiner*—Mark Spisich

(57) ABSTRACT

A hairbrush assembly includes an elongated first cylinder having a first end and a second end. An elongated second cylinder is positioned on and is rotatable with respect to the first cylinder. The second cylinder has a distal end and a proximal end with respect to the second end of the first cylinder. The second end extends outwardly from the distal end of the second cylinder. The second cylinder has a plurality of rows of aligned apertures extending from the proximal end and toward the distal end. A plurality of bristle assemblies is provided and each is positioned between the first and second cylinders adjacent to the first end of the first cylinder. Each of the bristle assemblies is selectively positioned in an extended position extending outwardly of the apertures or in a retracted position positioned within an interior space defined between the first and second cylinders.

10 Claims, 5 Drawing Sheets

HAIRBRUSH ASSEMBLY

BACKGROUND OF THE INVENTION

1. Field of the Invention

The present invention relates to hairbrush devices and more particularly pertains to a new hairbrush device for brushing hair and which includes retractable bristles for the efficient removal of hair and other material from the bristles as wells for forming a compact hairbrush device that can be easily stored in a small compartment while traveling.

2. Description of the Prior Art

The use of hairbrush devices is known in the prior art. U.S. Pat. No. 3,108,305 describes a self cleaning hairbrush which allows for the retraction of bristles into a housing so that material on the bristles is extracted. Another type of hairbrush device is U.S. Pat. No. 4,574,416 having a lever attached to retractable bristles for selectively pulling the bristles through a plate and again removing any material thereon. Still yet another such device is found in U.S. Pat. No. 6,681,775 which again includes a lever for retracting the bristles of a brush.

While these devices fulfill their respective, particular objectives and requirements, the need remains for a device that may be used for retracting bristles in such a manner that and hair or other material positioned thereon will be removed during the process of retracting the bristles. Additionally, once the bristles are in a retracted position, the device will take up relatively little space compared with a conventional hairbrush and therefore will be easily stored when used during traveling.

SUMMARY OF THE INVENTION

The present invention meets the needs presented above by generally comprising an elongated first cylinder having a first end and a second end. An elongated second cylinder is positioned on and is rotatable with respect to the first cylinder. The second cylinder has a distal end and a proximal end with respect to the second end of the first cylinder. The second end extends outwardly from the distal end of the second cylinder. The second cylinder has a plurality of rows of aligned apertures extending from the proximal end and toward the distal end. A plurality of bristle assemblies is provided and each is positioned between the first and second cylinders adjacent to the first end of the first cylinder. Each of the bristle assemblies is selectively positioned in an extended position extending outwardly of the apertures when the first cylinder is rotated in a first direction with respect to the second cylinder, or in a retracted position positioned within an interior space defined between the first and second cylinders when the first cylinder is rotated in a second direction.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
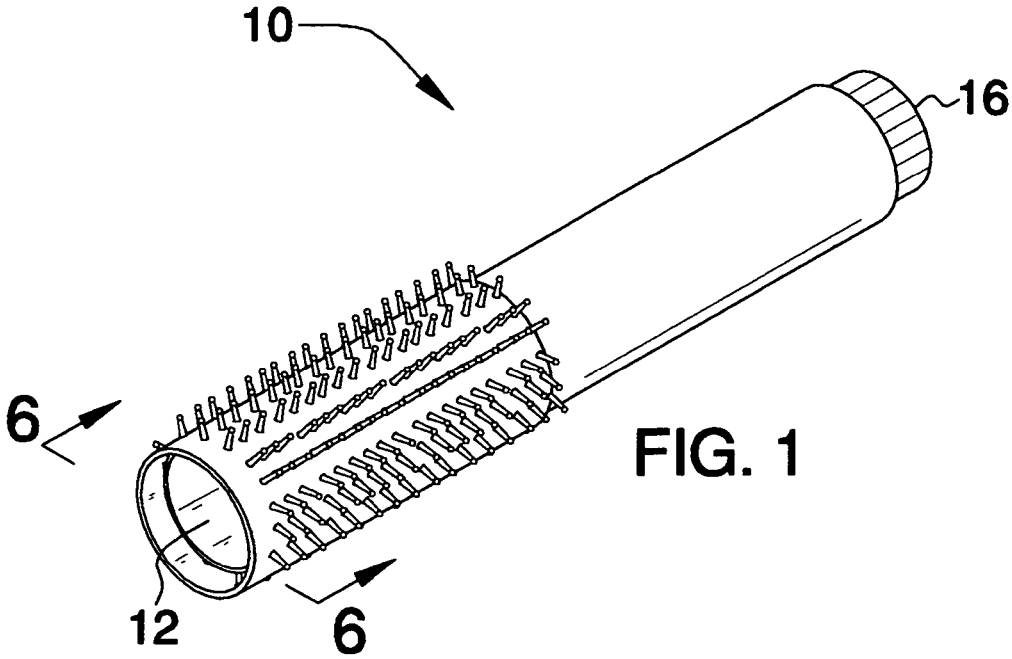
FIG. 1 is a perspective view of a hairbrush assembly according to the present invention.
Figure 2:
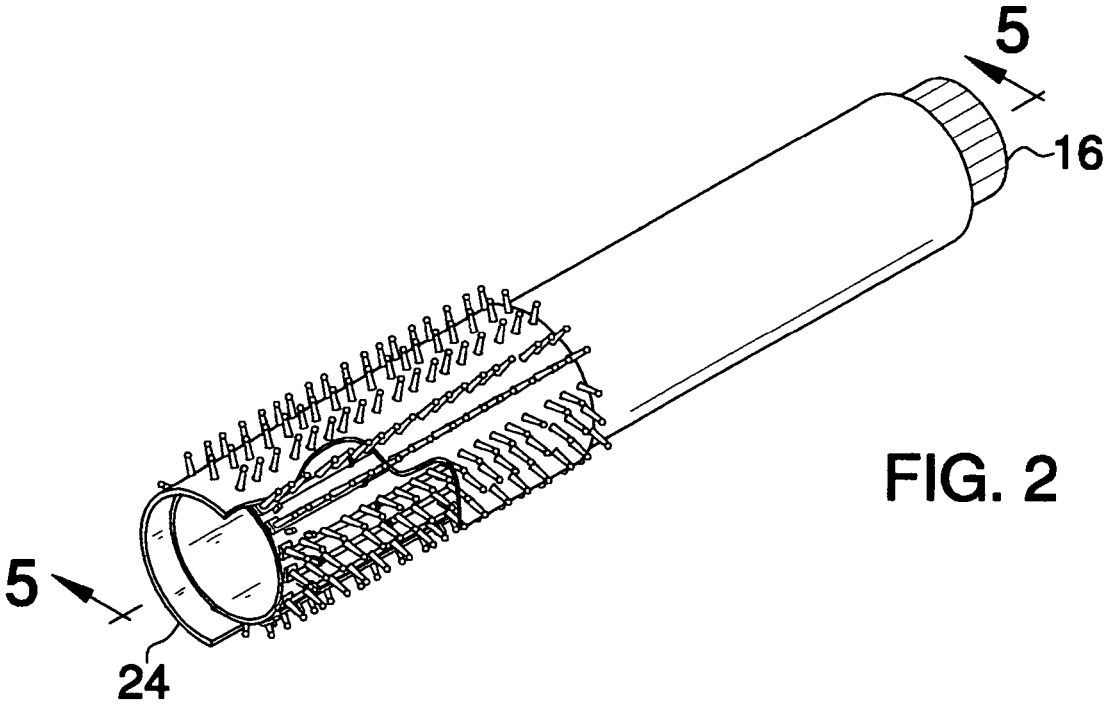
FIG. 2 is a perspective broken view of the present invention.
Figure 3:
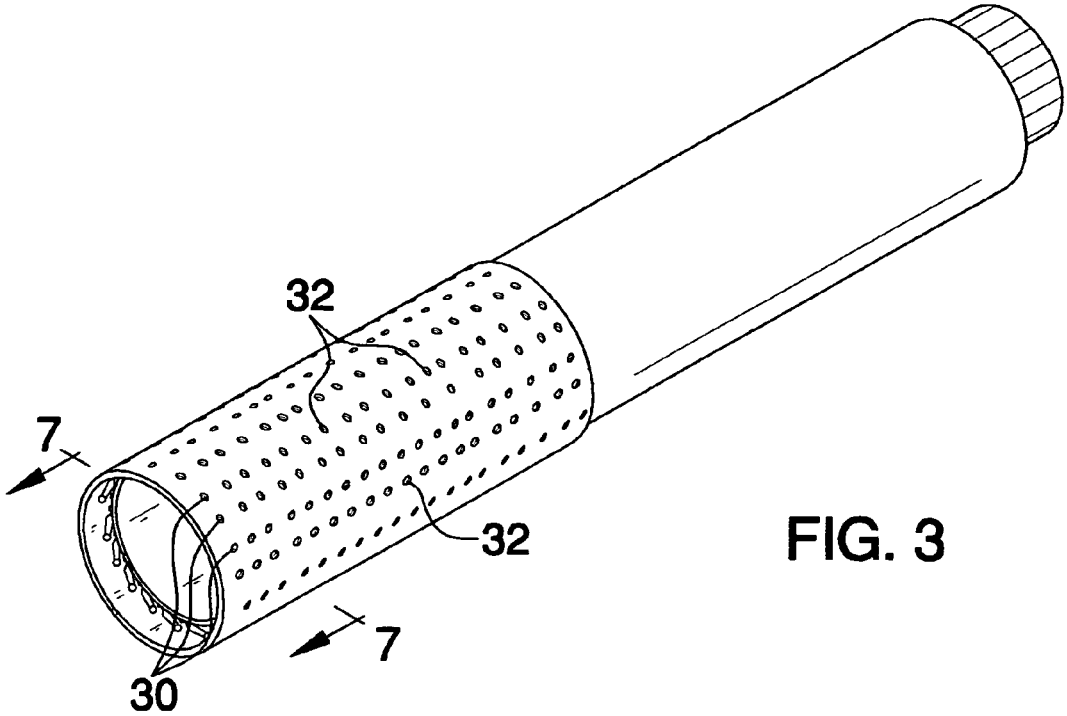
FIG. 3 is a perspective view of the present invention.
Figure 4:
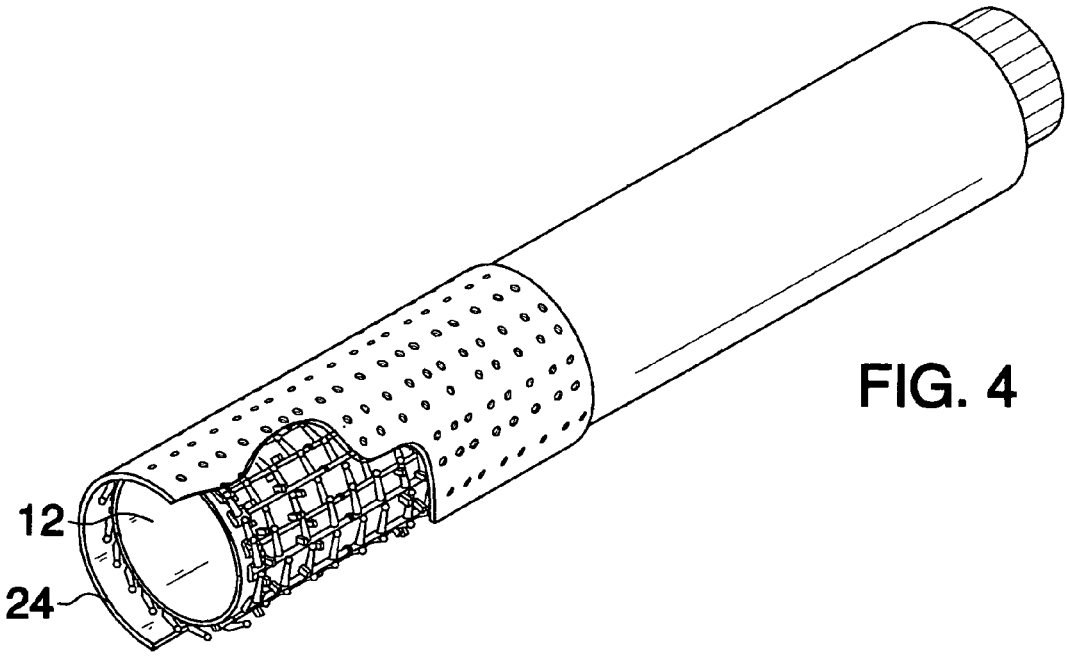
FIG. 4 is a perspective broken view of the present invention.
Figure 5:
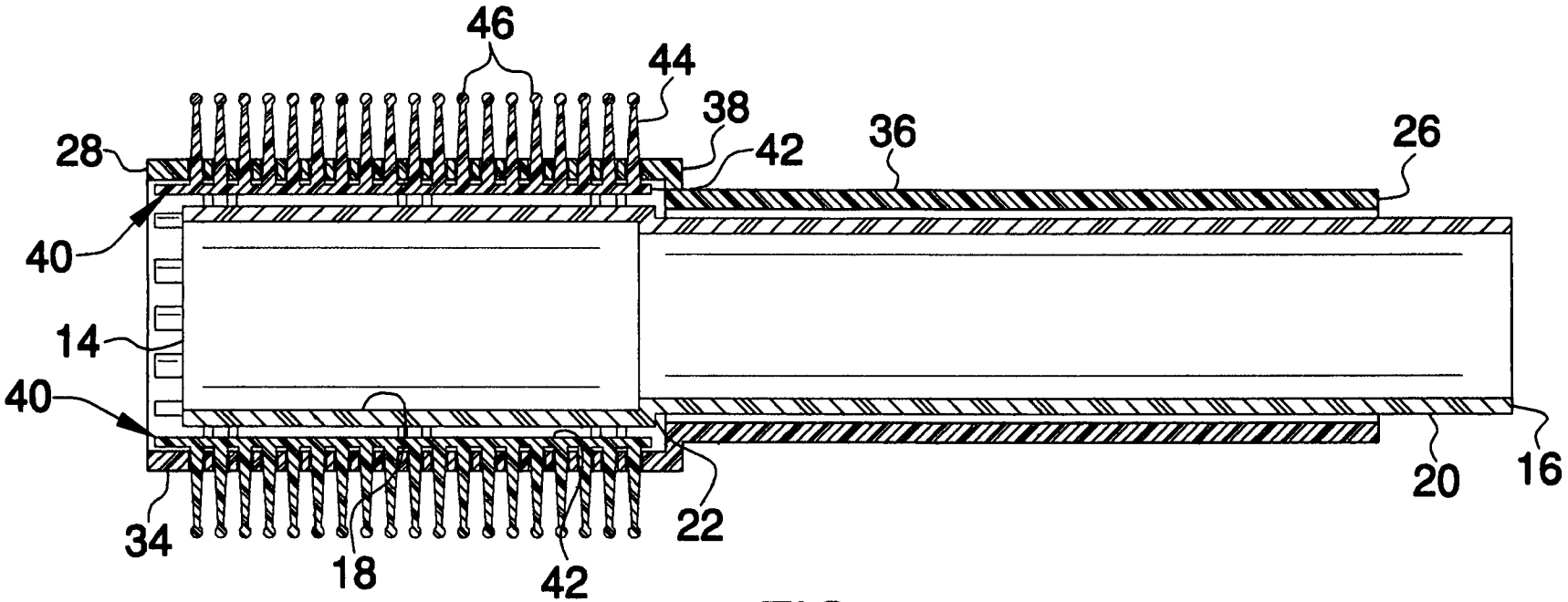
FIG. 5 is a cross-sectional view taken along line 5-5 of FIG. 2 of the present invention.

With reference now to the drawings, and in particular to FIGS. 1 through 8 thereof, a new hairbrush device embodying the principles and concepts of the present invention and generally designated by the reference numeral 10 will be described.

As best illustrated in FIGS. 1 through 8, the hairbrush assembly 10 generally comprises an elongated first cylinder 12 that has a first end 14 and a second end 16. The first cylinder 12 has a first portion 18 positioned adjacent to the first end 14 and a second portion 20 positioned adjacent to the second end 16. The first portion 18 has a greater diameter than the second portion 20 and a lip 22 is defined at a juncture of the first 18 and second 20 portions.

An elongated second cylinder 24 is positioned on and is rotatable with respect to the first cylinder 12. The second cylinder 24 has a distal end 26 and a proximal end 28 with respect to the first end 14 of the first cylinder 12. The second end 16 extends outwardly from the distal end 26 of the second cylinder 24 and defines a handle for rotating the first cylinder 12 with respect to the second cylinder 24. The second cylinder 24 has a plurality of rows 30 of aligned apertures 32 extending from the proximal end 28 and toward the distal end 26. The second cylinder 24 has a first section 34 positioned around and substantially covering the first portion 18 and a second section 36 positioned around the second portion 20. The first section 34 has a greater diameter than the second section 36 so that a shoulder 38 is defined between the first 34 and second 36 sections. The shoulder 38 is positioned adjacent to the lip 22 and inhibits movement of the second section 36 over the first portion 18.

A plurality of bristle assemblies 40 is provided. Each of the bristle assemblies 40 is positioned between the first 12 and second 24 cylinders and is adjacent to the first end 14 of the first cylinder 12. Each of the bristle assemblies 40 is selectively positioned in an extended position extending outwardly of the apertures 32 when the first cylinder 12 is rotated in a first direction with respect to the second cylinder 24. The bristle assemblies 40 are placed a retracted position positioned within an interior space defined between the first 12 and second 24 cylinders when the first cylinder 12 is rotated in a second direction.

Figure 6:
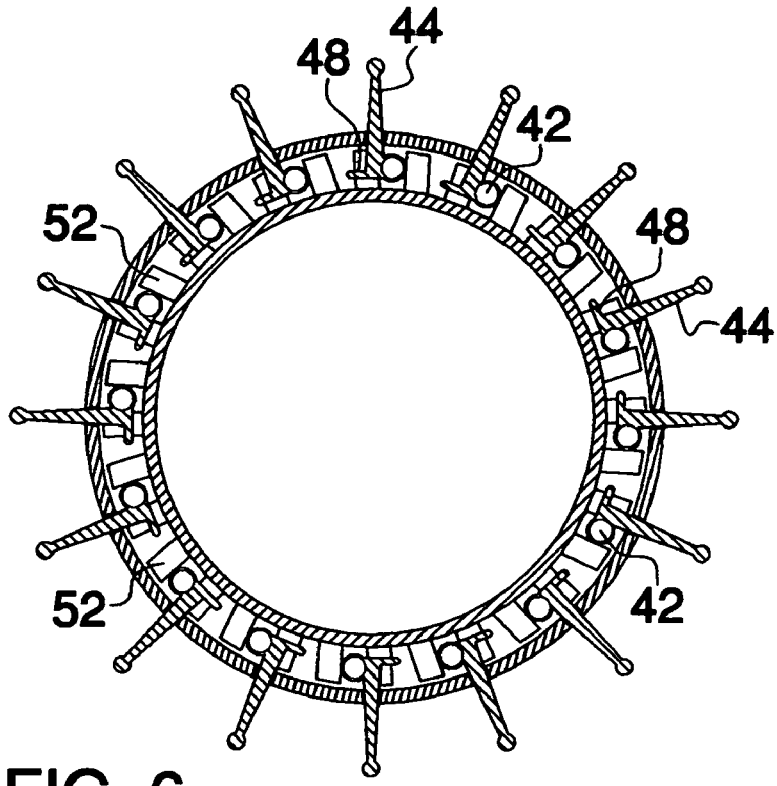
FIG. 6 is a cross-sectional view taken along line 6-6 of FIG. 1 of the present invention.
Figure 7:
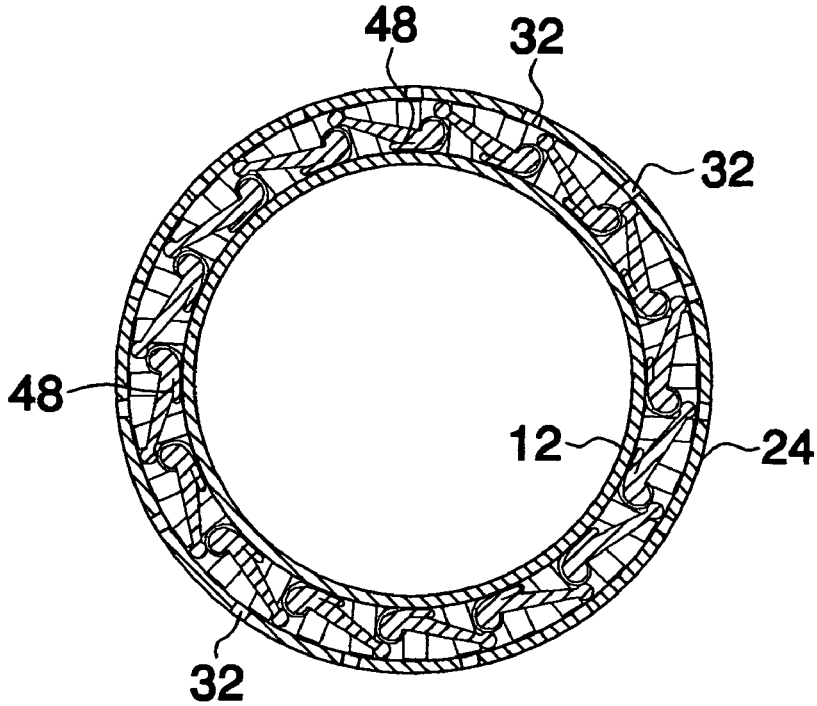
FIG. 7 is a cross-sectional view taken along line 7-7 of FIG. 3 of the present invention.
Figure 8:
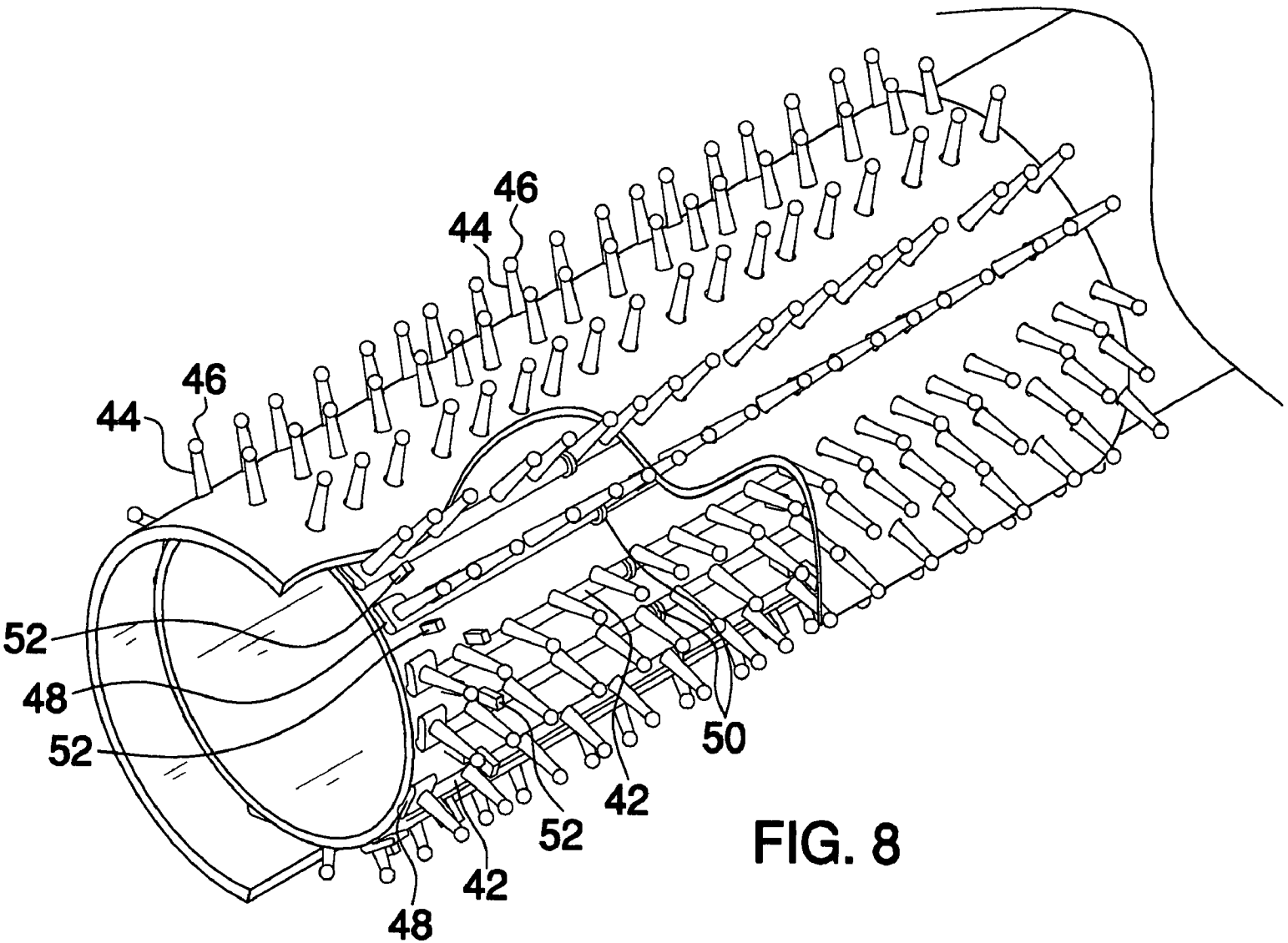
FIG. 8 is an enlarged perspective broken view of the present invention.

Each of the bristle assemblies 40 includes an elongated plate 42 that extends from the first end 14 of the first cylinder 12 to the lip 22 and is positioned between the first 12 and second 24 cylinders. The elongated plate 42 is comprised of a resiliently flexible material. Each of plurality of rods 44 is attached to the plate 42 and aligned with each other. Each of the rods 44 is substantially perpendicular orientated with respect to a longitudinal axis of the elongated plate 42. The rods 44 each haves a free end 46 that is preferably rounded. The rods 44 are also preferably comprised of a resiliently flexible material. A plurality of biasing members 48 is attached to the elongated plate 42 and is configured to bias the rods 44 upwardly away from the first cylinder and through one of the rows 30 of the apertures 32. The biasing members 48 comprise a resiliently flexible panel that is attached to the plate 42 and is orientated substantially perpendicular to rods 44. The panels, or biasing members 48, bend when the plate 42 is rotated as the rods 44 are moved toward the first cylinder 12 as shown in FIG. 7. FIG. 6 shows the biasing members 48 moved to their perpendicular orientation wherein the rods 44 are extended through the apertures 32. Peripheral flanges 50 are positioned on the plate 42 to more efficiently allow rotation of the plate 42.

A plurality of stabilizing members 52 is attached to the first cylinder 12 and extends toward the second cylinder 24. The stabilizing members 52 are positioned between adjacent ones of the bristle assemblies 40 and comprise upright wall sections preventing lateral movement of the plates 42 on the first cylinder 12. At least two of the stabilizing members 52 are positioned between each of the adjacent ones of the bristle assemblies 40.

In use, a person rotates the first cylinder 12 in the first direction so that the free ends 46 of the rods 44 are extended through the apertures 32. The rods 44 are then used as bristles for brushing the person's hair. When finished, the person rotates the first cylinder 12 in the second direction to retract the rods 44 into the second cylinder 24. The rods 44 are spaced from each other a same distance as between the apertures 32. The stabilizing members 52 and shoulder 38 prevent movement of the plates 42 away from their associated row 30 of apertures 32 to ensure that the rods 44 will always line up with one of the rows 30. When the rods 44 are retracted, any hair attached to the rods 44 will be left on the second cylinder 24 for easy removal and the hairbrush assembly 10 will have a compact shape for packing ease.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A hair brush apparatus comprising:

an elongated first cylinder having a first end and a second end;

an elongated second cylinder being positioned on and being rotatable with respect to said first cylinder, said second cylinder having a distal end and a proximal end with respect to said first end of said first cylinder, said second end extending outwardly from said distal end of said second cylinder, said second cylinder having a plurality of rows of aligned apertures extending from said proximal end and toward said distal end, said first cylinder having a first portion positioned adjacent to said first end and a second portion positioned adjacent to said second end, said first portion having a greater diameter than said second portion and a lip being defined at a juncture of said first and second portions, said second cylinder having a first section positioned around and substantially covering said first portion and a second section positioned around said second portion, said first section having a greater diameter than said second section such that a shoulder is defined between said first and second sections, said shoulder being positioned adjacent to said lip and inhibiting movement of said second section over said first portion;

a plurality of bristle assemblies, each of said bristle assemblies being positioned between said first and second cylinders and being adjacent to said first end of said first cylinder, each of said bristle assemblies being selectively positioned in an extended position extending outwardly of said apertures when said first cylinder is rotated in a first direction with respect to said second cylinder or in a retracted position positioned within an interior space defined between said first and second cylinders when said first cylinder is rotated in a second direction.

2. The apparatus according to claim 1, wherein each of said bristle assemblies includes:

an elongated plate positioned between said first and second cylinders and extending from said first end of said first cylinder to said lip, a plurality of rods, each of said rods being attached to said plate and being aligned with each other and each being substantially perpendicular orientated with respect to a longitudinal axis of said elongated plate, each of said rods having a free end;

a plurality of biasing members, each of said biasing members being attached to said elongated plate and being configured to bias said rods upwardly away from said first cylinder and through one of said rows of said apertures.

3. The apparatus according to claim 2, wherein each of said biasing members comprises a resiliently flexible panel being attached to said plate and being orientated substantially perpendicular to rods.

4. The apparatus according to claim 2, wherein each of said free ends is rounded.

5. The apparatus according to claim 2, wherein each of said rods is comprised of a resiliently flexible material and said elongated plate is comprised of a resiliently flexible material.

6. The apparatus according to claim 2, further including a plurality of stabilizing members being attached to said first cylinder and extending toward said first second cylinder, said stabilizing members being positioned between adjacent ones of said bristle assemblies.

7. The apparatus according to claim 6, wherein at least two of said stabilizing members are positioned between each of said adjacent ones of said bristle assemblies.

8. The apparatus according to claim 1, further including a plurality of stabilizing, members being attached to said first cylinder and extending toward said f second cylinder, said stabilizing members being positioned between adjacent ones of said bristle assemblies.

9. The apparatus according to claim 8, wherein at least two of said stabilizing members are positioned between each of said adjacent ones of said bristle assemblies.

10. A hair brush apparatus comprising:

an elongated first cylinder having a first end and a second end, said first cylinder having a first portion positioned adjacent to said first end and a second portion positioned adjacent to said second end, said first portion having a greater diameter than said second portion and a lip being defined at a juncture of said first and second portions;

an elongated second cylinder being positioned on and being rotatable with respect to said first cylinder, said second cylinder having a distal end and a proximal end with respect to said first end of said first cylinder, said second end extending outwardly from said distal end of said second cylinder, said second cylinder having a plurality of tows of aligned apertures extending from said proximal end and toward said distal end, said second cylinder having a first section positioned around and substantially covering said first portion and a second section positioned around said second portion, said first section having a greater diameter than said second section such that a shoulder is defined between said first and second sections, said shoulder being positioned adjacent to said lip and inhibiting movement of said second section over said first portion;

a plurality of bristle assemblies, each of said bristle assemblies being positioned between said first and second-cylinders and being adjacent to said first end of said first cylinder, each of said bristle assemblies being selectively positioned in an extended position extending outwardly of said apertures when said first cylinder is rotated in a first direction with respect to said second cylinder or in a retracted position positioned within an interior space defined between said first and second cylinders when said first cylinder is rotated in a second direction, each of said bristle assemblies including;

an elongated plate positioned between said first and second cylinders and extending from said first end of said first cylinder to said lip, said elongated plate being comprised of a resiliently flexible material;

a plurality of rods, each of said rods being attached to said plate and being aligned with each other and each being substantially perpendicular orientated with respect to a longitudinal axis of said elongated plate, each of said rods having a free end, each of said free ends being rounded, each of said rods being comprised of a resiliently flexible material;

a plurality of biasing members, each of said biasing members being attached to said elongated plate and being configured to bias said rods upwardly away from said first cylinder and through one of said rows of said apertures, each of said biasing members comprising a resiliently flexible panel being attached to said plate and being orientated substantially perpendicular to rods; and a plurality of stabilizing members being attached to said first cylinder and extending toward said second cylinder, said stabilizing members being positioned between adjacent ones of said bristle assemblies, at least two of said stabilizing members being positioned between each of said adjacent ones of said bristle assemblies.

* * * * *